US005702309A

United States Patent [19]

Lee

[11] Patent Number: 5,702,309

[45] Date of Patent: Dec. 30, 1997

[54] GOLF TRAINING DEVICE

[76] Inventor: Alan Lee, 14F-2, No. 90, Joukung Street, Taipei, Taiwan

[21] Appl. No.: 807,940

[22] Filed: Mar. 4, 1997

[30] Foreign Application Priority Data

Sep. 11, 1996 [TW] Taiwan ..... 85214042

[51] Int. Cl.[6] ..... A63B 69/36

[52] U.S. Cl. ..... 473/235

[58] Field of Search ..... 473/235, 278, 473/373, 374, 376, 377, 355, 361; 273/186.5

[56] References Cited

U.S. PATENT DOCUMENTS

| | | | |
|---|---|---|---|
| 3,401,941 | 9/1968 | Hesidence | 473/235 |
| 3,721,447 | 3/1973 | Louderback | 473/235 |
| 4,149,726 | 4/1979 | Tredway, Sr. | 473/235 |
| 4,826,173 | 5/1989 | Brown | 473/235 |
| 5,082,284 | 1/1992 | Reed | 473/235 |
| 5,156,403 | 10/1992 | Martino | 473/278 |

FOREIGN PATENT DOCUMENTS

| | | | |
|---|---|---|---|
| 2575075 | 6/1986 | France | 273/186.5 |

*Primary Examiner*—Mark S. Graham
*Attorney, Agent, or Firm*—Bacon & Thomas

[57] ABSTRACT

A golf training device includes a flexible ground pad on which an artificial lawn is formed and a ball holder made of an elastically deformable material, having a tee mounted to and extending from a flat base of the ball holder. The tee of the ball holder is located on the ground pad to support a training ball to be hit thereon. The training ball has a light-weighted core enclosed by a stretchable cover layer in a relative slippery manner. A loop portion of a Velcro fastener is fixed on the ball and a hook portion of the Velcro fastener is fixed on the head of a golf club so that when the club is used to hit the ball, the contact between the hook and loop portions of the Velcro fastener makes the ball stick to the club and thus not arbitrarily fly away. Also by examining the location of the ball on the club head, a player may know if the ball is hit correctly and thus improvement may be exercised in the next hit.

5 Claims, 5 Drawing Sheets

GOLF TRAINING DEVICE

FIELD OF THE INVENTION

The present invention relates to a golf training device and in particular to a golf training device having a high safety design.

BACKGROUND OF THE INVENTION

A golf course usually occupies a very large area which is not readily available in an urban area and thus the golf courses are most available in the rural areas. Thus, to play golf, urban people have to drive or travel quite a distance to reach the golf courses. To provide the urban people with a place to train their golf skill, golf training facilities are available, but these facilities are most likely to be located in the sub-urban areas due to lower land cost in the sub-urban areas. Thus, although the golf training facility is closer and easier to reach than the regular golf courses, it still takes time in traffic to reach there.

Thus, personal golf training devices are available in the market. FIG. 1 of the attached drawings shows an example of the conventional golf training device, which comprises a soft ground pad A having a suitable size to be placed on for example the ground to support thereon a golf ball B to be hit. A catching net C is arranged upright in front of the ground pad A to catch the golf ball B after it is hit. The catching net C catches the hit and flying ball B and prevents the ball B from making damage to properties and people.

However, since the catching net C cannot have an unlimited size and since the travelling path of the hit ball B may be arbitrary and not directly toward the catching net C, the catching net C may not be effective to obstruct or intercept the flying-away ball B.

Further, if the player wants to know if the golf ball is hit in a correct way or at the correct point, the player has to carefully and cautiously watch the ball hitting the catching net. If the player doesn't observe the point where the ball impacts the catching net, the player would not be able to know if the ball is hit correctly. Thus, with such a conventional design, it is difficult for a player to precisely know if the ball is hit correctly.

It is therefore desirable to provide an improved and safer golf training device which not only improves the safety in doing golf training, but also allows a player to easily know if the golf ball is hit correctly.

SUMMARY OF THE INVENTION

Therefore, the principal object of the present invention is to provide a golf training device which prevents the ball that is hit by the golf club from flying away uncontrollably so as to avoid damage to properties and people.

Another object of the present invention is to provide a golf training device which allows a player to examine if the ball is hit correctly so as to improve his or her skill.

In accordance with the present invention, there is provided a golf training device comprising a flexible ground pad on which an artificial lawn is formed and a ball holder made of an elastically deformable material, having a tee mounted to and extending from a flat base of the ball holder. The tee of the ball holder extends upward through a hole formed on the ground pad to have the flat base of the ball holder retained under the ground pad. The tee has a concave top end adapted to support a ball therein. The ball has a core made of a foam material and sized and shaped similar to a real golf ball with a plurality of dimples formed thereon and a cover layer made of a stretchable and elastically deformable material to completely enclose the core in such a manner to allow slippage of the cover layer relative to the core upon being hit. The ball has a loop portion of a hook and loop type fastener fixed thereon and correspondingly, a hook portion is fixed on the head of a golf club so that when the ball is hit by the club, the ball engages and sticks to the head of the club head to prevent the ball from arbitrarily flying away.

BRIEF DESCRIPTION OF THE DRAWINGS

The present invention will be better understood from the following description of a preferred embodiment thereof with reference to the attached drawings, wherein.

DETAILED DESCRIPTION OF THE PREFERRED EMBODIMENTS

Figure 1:
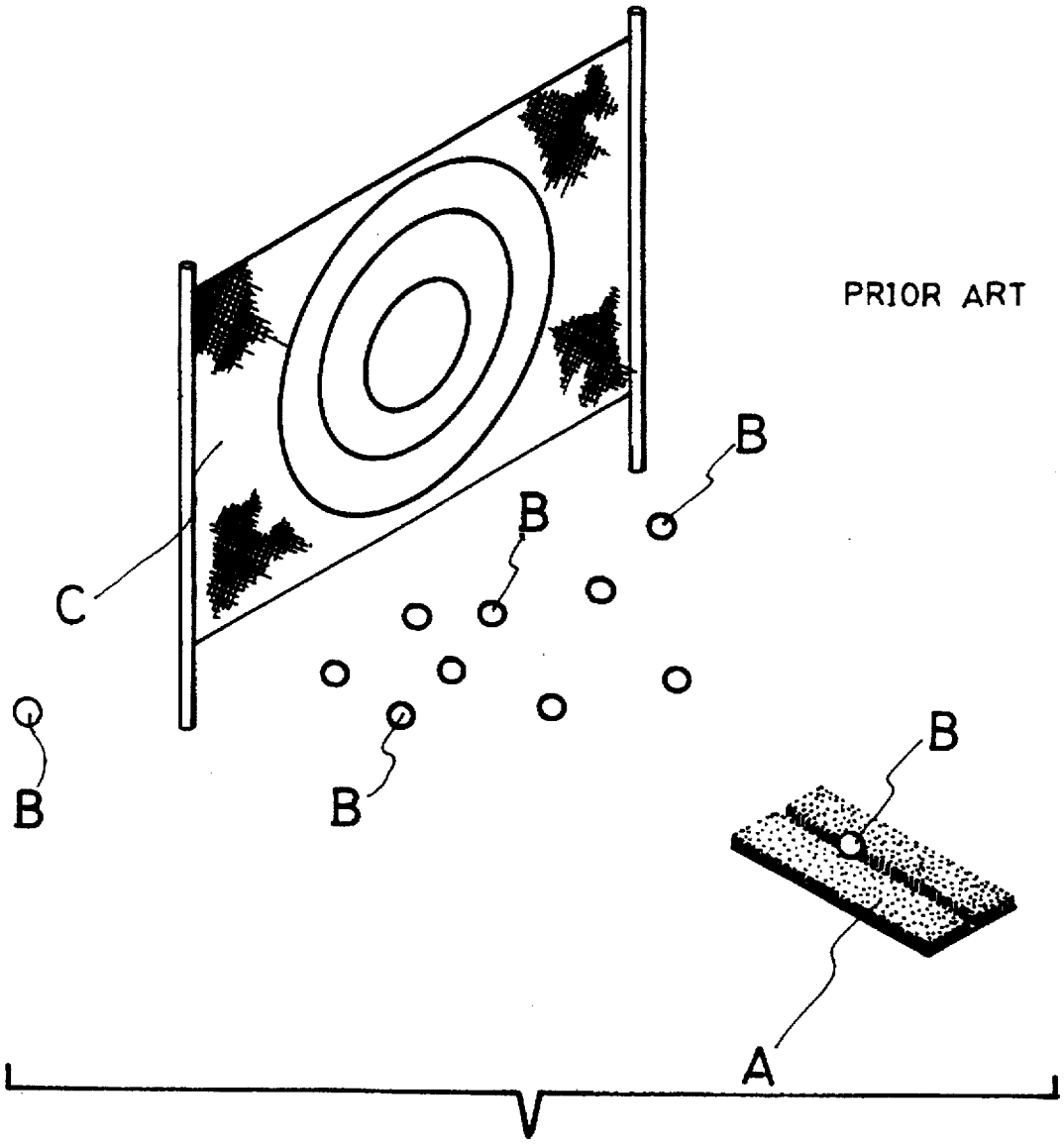
FIG. 1 is a perspective view showing a conventional golf training device.
Figure 2:
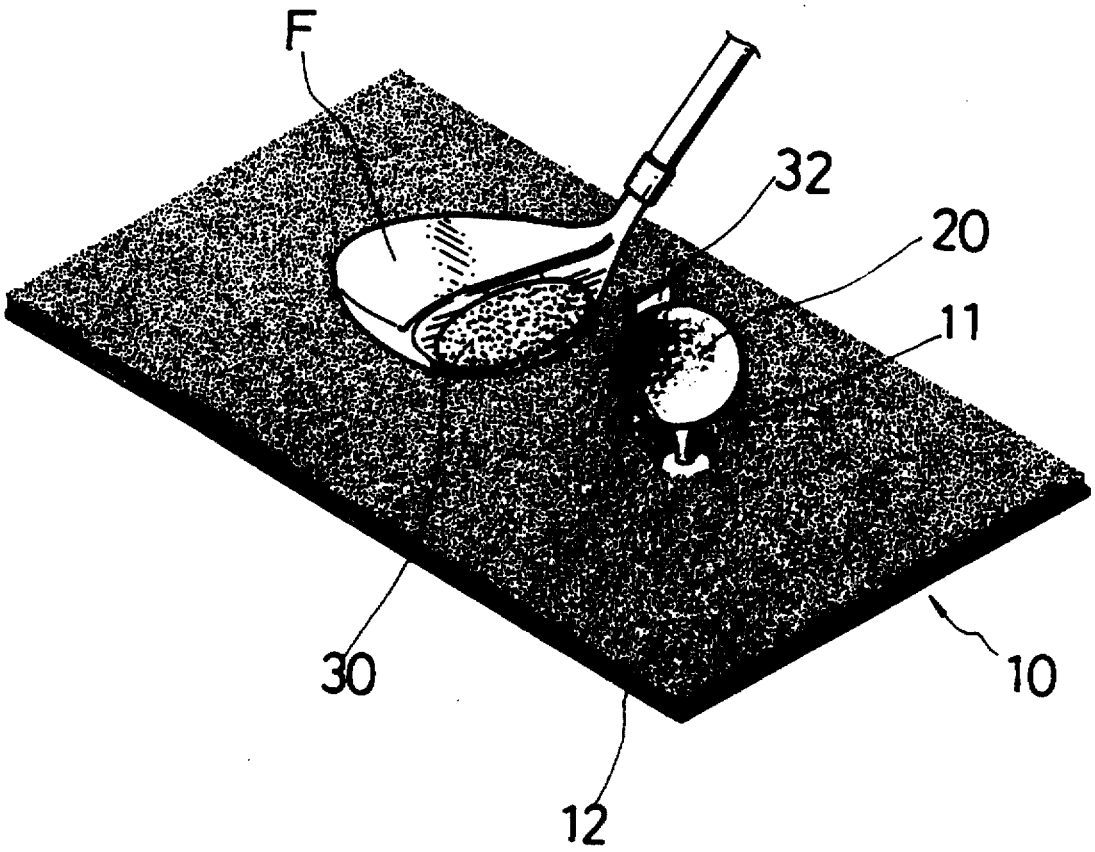
FIG. 2 is a perspective view showing a golf training device constructed in accordance with the present invention.
Figure 3:
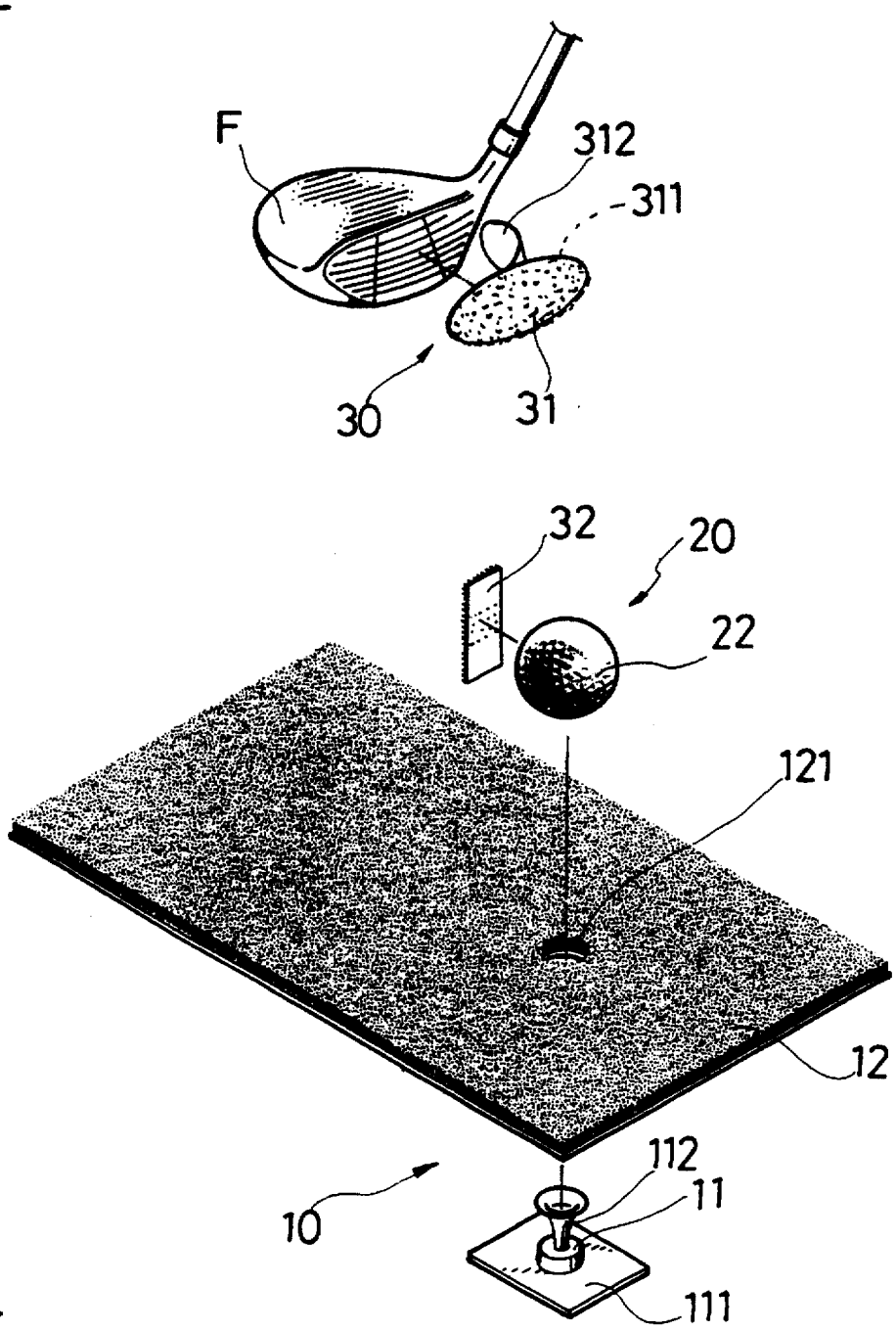
FIG. 3 is an exploded perspective view of the golf training device of the present invention.

With reference to the drawings and in particular to FIGS. 2 and 3, wherein a golf training device constructed in accordance with the present invention is shown, the golf training device of the present invention comprises a ball support 10 on which a spherical member or a training ball 20 having a size similar to a real golf ball is supported and adapted to be hit by a golf club F.

The golf club F comprises a head on which ball grasping means is attached to grasp and thus hold the training ball 20 on the club head once the club head gets into contact with the training ball 20. In the embodiment illustrated, the ball grasping means comprises a flexible pad 30 which is releasably and repeatedly adhered to the club head. Preferably, the pad 30 comprises a portion 31 of a two portion releasable fastening device on a front side thereof, such as the hook portion of a hook and loop type fastener which is commercially known as Velcro fastener. The pad 30 also comprises an adhesive layer 311 on a back side thereof to be adhered to the club head. Preferably, a peelable film 312 is initially provided on the adhesive layer 311 to prevent un-expected adhesion to other articles. By removing the film 312, the pad 30 is then adhered to the club head by means of the adhesive layer 311 to have the hook portion 31 fixed on the club head and facing outward.

The ball support 10 comprises a ground pad 12 having a sufficient area and made of a flexible material with artificial lawn on the top side thereof for the simulation of real lawn on a regular golf course. A ball holder 11 made of a resilient material comprises a flat base 111 to be placed under and held by the ground pad 12 and an upright tee 112 extending upward from the flat base 111. The tee 112 has an expanded top end with a concave top face for receiving and holding the training ball 20 thereon in doing golf training.

The ground pad 12 is provided with a hole 121 having a size larger than the expanded top end of the tee 112, but smaller than the flat base 111 of the ball holder 11 so as to be fit over the tee 112 and resting on the flat base 111 of the ball holder 11 to retain the ball holder 11 in position. The ball holder 11, particularly the tee 112 thereof, is made of a resilient material which undergoes elastic deformation when hit by the golf club F and is capable to restore its original shape and configuration for next hit.

Figure 4:
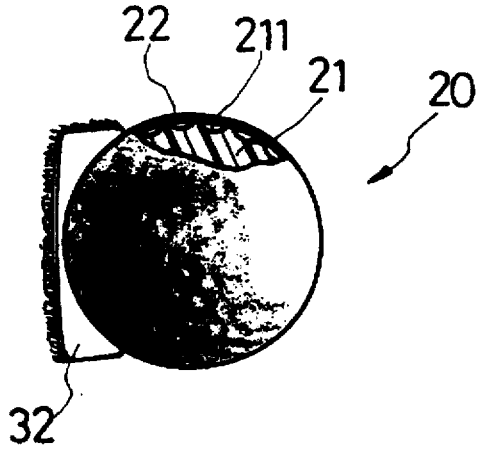
FIG. 4 is an exploded perspective view, partially broken, showing a golf training ball constructed in accordance with the present invention.

With reference to FIGS. 3 and 4, the training ball 20 comprises a spherical core 21 made of a light-weighted material, such as foam material, with a size and shape similar to a real golf ball. The core 21 has a plurality of dimples 211 formed on an outer surface thereof. A flexible, stretchable and elastically deformable cover layer 22, preferably made of a film or membranae of plastic or rubber material, is provided to completely enclose the core 21. The film or membrane that makes the cover layer 22 is capable of being stretched so as to endure the stretching caused by the hitting force applied thereon by the golf club F.

The dimples 211 allows the cover layer 22 to be provided around the core 21 in a non-secured manner so that a relative motion or slippage of the cover layer 22 relative to the core 21 is allowed and thus by the relative movement or slippage between the cover layer 22 and the core 21, the hitting force acting upon the training ball 20 may be partially absorbed.

The training ball 20 also comprises a second portion 32 of the two portion releasable fastening device, such as the loop portion of the hook and loop type fastener, fixed thereon. The loop portion 32 cooperates with the hook portion 31 of the pad 30 fixed on the club head to stick and hold the training ball 20 to the club head when the training ball 20 is hit by the club F. This prevents the training ball 20 from flying away as in a regular golf hitting condition and thus eliminates any possibility to have the flying-away ball damage any property and people. Even though the training ball 20 flies away after being hit, the light-weighted core 21 thereof only generates a very small impact on any article or people hit by the flying ball so as to reduce the potential damage.

Figure 5:
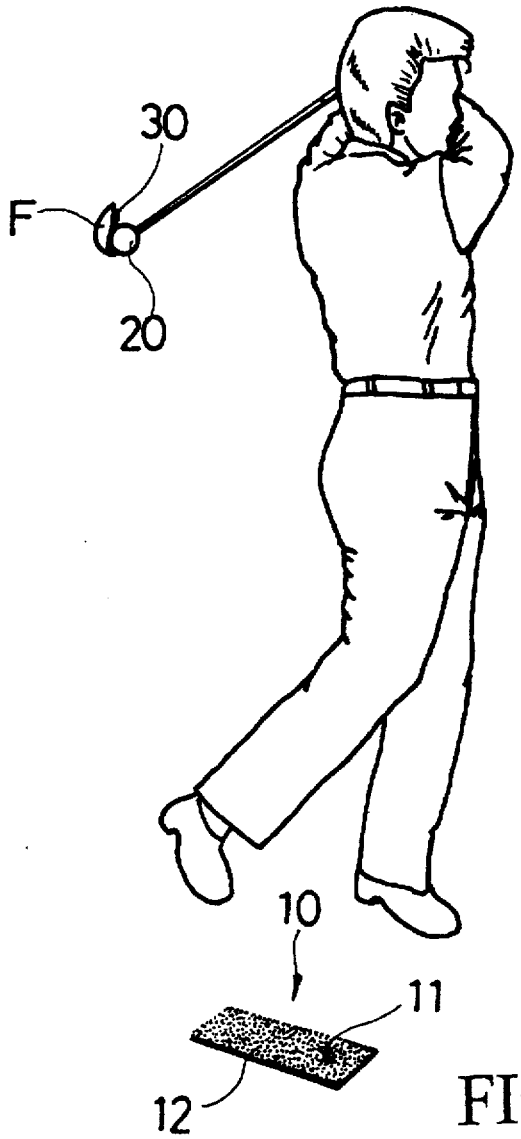
FIG. 5 is a perspective view showing the way of using the golf training device of the present invention.

Due to the elastic deformability and stretchability of the cover layer 22 of the training ball 20 and due to the relative movement or slippage between the cover layer 22 and the core 21, in hitting the ball 20 which is placed on the tee 112 of the ball support 10 with the club F, when the club head is brought into contact with the training ball 20 and the loop portion 32 that is fixed on the training ball 20 contacts and engages the hook portion 31 that is fixed on the club head and thus retains the training ball 20 on the club head, as shown in FIG. 5, so as to prevent the ball 20 from flying away, the inertial force that is created on the training ball 20 by the momentum of the club F is absorbed by the stretching and elastic deformation of the cover layer 22 of the training ball 20 as well as the relative slippage between the core 21 and the cover layer 22 of the ball 20. Such a stretching and elastic deformation of the cover layer 22 of the ball 20 also helps to retain the ball 20 on the club head when the swinging movement of the club F is stopped by the player.

Figure 6A:
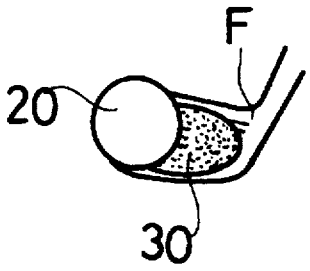
FIGS. 6A, 6B and 6C respectively show different conditions between the golf club and the golf training ball hit by the club.
Figure 6B:
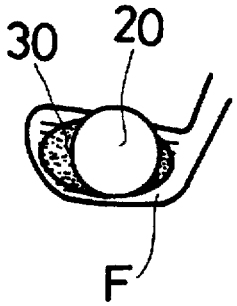
Figure 6C:
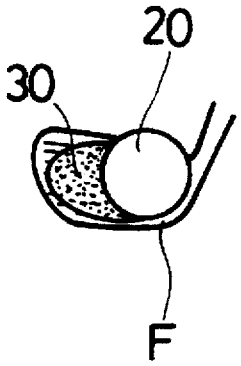

Further, by using the golf training device of the present invention, a better training result may also be obtained. Referring to FIGS. 6A, 6B and 6C, when the training ball 20 is hit by the club F, as discussed above, the ball 20 will stick to the club head and by examining the location of the ball 20 on the club head, as shown in FIGS. 6A–6C, one may known if the ball 20 is hit at the correct position so as to allow one to improve one's skill in the next training.

It is apparent that although the present invention is illustrated with the description of the preferred embodiment, it is contemplated that there may be changes and modifications in the described embodiment that can be carried out without departing from the scope of the invention which is intended to be limited only by the appended claims.

What is claimed is:

1. A golf training device comprising:

a ball support comprising a ground pad of a sufficient area, made of a resilient material and having a hole formed therein and a ball holder made of a resilient and elastically deformable material, comprising a flat base having a surface area larger than the hole of the ground pad and a tee mounted on the flat base and extending therefrom through the hole of the ground pad to have the ground pad resting on the flat base to retain the ball holder in position, the tee comprising a top end having a concave top surface;

a ball adapted to be placed on the concave surface of the tee to be hit, comprising a spherical core made of a light-weighted material and having a size and configuration similar to a golf ball with a plurality of dimples formed on a surface thereof and a cover layer made of a stretchable and elastically deformable material to completely enclose the core, the dimples formed on the surface of the core providing a relative slippery interface between the cover layer and the core when the ball is hit; and ball grasping means comprising a releasable fastening device which comprises two mated portions of which a first portion is adapted to be fixed on a head of a golf club and a second portion is fixed on the cover layer of the ball so that when the club is swung to hit the ball, the first and second portions of the releasable fastening device engage and stick to each other and thus hold the ball on the head of the golf club.

2. The golf training device as claimed in claim 1, wherein the releasable fastening device comprises a hook and loop type fastening device having a loop portion and a hook portion respectively fixed on the ball and the club head.

3. The golf training device as claimed in claim 1, wherein the first portion of the releasable fastening device comprises an adhesive layer with a peelable film attached thereon so that by removing the peelable film, the first portion is attachable to the head of the golf club by means of the adhesive layer thereof.

4. The golf training device as claimed in claim 1, wherein the light-weighted material that forms the core of the ball comprises a foam material.

5. The golf training device as claimed in claim 1, wherein the ground pad comprises artificial lawn formed on a top side thereof.

* * * * *